US005367955A

United States Patent [19]

Hara et al.

[11] Patent Number: 5,367,955

[45] Date of Patent: Nov. 29, 1994

[54] METHOD AND DEVICE FOR CLEANING AN INK ROLLER TRAIN FOR USE IN PRINTING MACHINES

[75] Inventors: Akira Hara, Tokyo; Toshisaburou Takagi, Urawa, both of Japan

[73] Assignee: B-J Trading Ltd., Tokyo, Japan

[21] Appl. No.: 71,034

[22] PCT Filed: Feb. 16, 1990

[86] PCT No.: PCT/JP90/00191

§ 371 Date: Sep. 28, 1990

§ 102(e) Date: Sep. 28, 1990

[87] PCT Pub. No.: WO90/09283

PCT Pub. Date: Aug. 23, 1990

Related U.S. Application Data

[63] Continuation of Ser. No. 582,219, Sep. 28, 1990, abandoned.

[30] Foreign Application Priority Data

Feb. 17, 1989 [JP] Japan ..... 1-36016

[51] Int. Cl.[5] ..... B41F 35/00

[52] U.S. Cl. ..... 101/424; 101/425

[58] Field of Search ..... 101/423, 424, 425, 483, 101/487; 15/208, 209.1, 256.5, 256.51, 256.53; 355/300

[56] References Cited

U.S. PATENT DOCUMENTS

| | | | |
|---|---|---|---|
| 3,815,702 | 6/1974 | Paananen | 180/69.1 |
| 4,239,792 | 12/1980 | Ludwa | 428/287 |
| 4,651,644 | 3/1987 | Kaempfe et al. | 101/425 |
| 4,760,857 | 8/1988 | Shiba et al. | 101/425 |
| 4,867,064 | 9/1989 | Hara et al. | 101/425 |
| 4,906,513 | 3/1990 | Kebbell et al. | 15/209 R |
| 4,933,015 | 6/1990 | White | 15/209 R |

FOREIGN PATENT DOCUMENTS

| | | |
|---|---|---|
| 148164 | 11/1980 | Japan . |
| 171346 | 8/1986 | Japan . |
| 62-125001 | 6/1987 | Japan . |
| 37944 | 2/1988 | Japan . |
| 0258088 | 2/1990 | Japan . |

*Primary Examiner*—Ren Yan

*Attorney, Agent, or Firm*—Morgan & Finnegan

[57] ABSTRACT

Ink remaining on an ink roller (R) for applying ink to a plate cylinder is softened by a solvent, and then a cleaning cloth (4) is moved intermittently or continuously in press-contact with the ink roller so that an oil absorptive layer of the cleaning cloth absorbs and hold the softened ink. The cleaning cloth which has absorbed the ink is sent to a cleaning cloth disposing section (8) to be cut off by a cutter (3), or to be taken up by a set length by a taking-up roll to be wasted together with the taking-up roll. The cleaning cloth at least comprises an oil absorptive layer and an oil impermeable layer, and has good softened ink absorptiveness and is free from the leakage of the absorbed ink. Especially the cleaning cloth having a non-flowback oil impermeable layer can perfectly hold the absorbed ink, and has good disposability. Especially the cleaning cloth containing an oil coagulant in the oil absorptive layer can solidify or gelatinize the absorbed ink by being subjected to cooling following heating, which facilitates the disposal of the cleaning cloth.

4 Claims, 5 Drawing Sheets

METHOD AND DEVICE FOR CLEANING AN INK ROLLER TRAIN FOR USE IN PRINTING MACHINES

This is a continuation of co-pending application Ser. No. 07/582,219, filed on Sep. 28, 1990, now abandoned.

TECHNICAL FIELD

This invention relates to a method and a device for cleaning an ink roller train for use in printing machines, in which a web or a sheet of cleaning cloth automatically absorbs ink remaining on the ink roller train and then is disposed of, and which speed up and facilitate the cleaning operation.

BACKGROUND ART

Generally an offset printing machine includes, as shown in FIG. 9, three cylinders, a plate cylinder 51, a blanket cylinder 52 and an impression cylinder 53 which are arranged with the axial lines being parallel with each other and are capable of contacting to each other. A press plate (not shown) of zinc or aluminium is wound on the plate cylinder 51, and the rubber blanket is wound on the blanket cylinder 52.

The press plate is supplied with water by a dampening arrangement 54 to keep the non image area of the press plate except the printing image thereof wet, and an oily ink is applied to the surface of the press plate by an inking arrangement 55.

As shown in FIG. 10, the inking arrangement 55 has an ink roller train mechanism for applying ink evenly to the surface of the press plate.

The ink roller train mechanism comprises a metal link fountain roller 60 for taking ink out of an ink fountain, an ink ductor 61 for receiving the ink from the ink fountain roller, a metal reciprocating ink roller 62 contacting the ink ductor for receiving the ink therefrom, downstream metal reciprocating ink rollers 54 for receiving the ink from the reciprocating ink roller through ink distributing rollers 63, and form rollers 55 for applying the ink from the downstream reciprocating ink rollers 54 to the surface of the press plate.

In this ink roller train mechanism the ink conducted from the ink fountain 59 is spread evenly on the surfaces of the ink roller train by the plural metal reciprocating rollers arranged through the intermediary of the elastic rollers to be applied evenly to the surface of the plate cylinder by the form rollers.

In the offset printing machines, the ink roller train are cleaned when a printing color is changed or during a pause of a printing operation. This cleaning operation is performed with the ink roller train set on idling after first the form roller 65 and the surface of the press plate, and the ink ductor 51 and the reciprocating ink roller 52 are set apart from each other respectively, and the supply and application of the ink to the plate cylinder are stopped.

Conventionally, the cleaning of the ink roller train are performed largely by two methods. In a first method, a cleaning oil, or a solvent, e.g., kerosene, linseed oil, or others, is sprinkled on the idling ink rollers, and when it is confirmed that the solvent has been distributed all over the respective ink roller train and sufficiently softened ink on the ink roller train, the ink is removed by a knife, and next the ink still remaining on the ink roller train is wiped off by cloths. This is thesocalled completely manual operation.

A second cleaning method uses a manually operable ink cleaning device 66- This ink cleaning device 66 comprises an ink pan 68 detachably attached to a support 67 secured to the side frame of the offset printing machine movably back and forth in the direction perpendicular to the shafts of the ink roller train, and a doctor blade 69 attached to the ink pan on the side nearer to the ink roller train, opposed to the ink roller train so as to scrape the ink 71 on the surface of the ink roller train. In the cleaning operation, first the ink pan 68 is set, a solvent is sprinkled on the surfaces of the idling ink rollers, and the ink roller train are set on idling until the solvent is distributed all over the respective ink roller train. Then a handle 70 is operated to move the ink pan forward to abut on the surface of the ink roller train, and the ink 71 is scraped off the surface of the ink roller train into the ink pan. At this time, because of the property that the ink 71 on the ink roller train flows from a higher concentration to a lower concentration, the ink on the ink roller train other than the ink roller with the doctor blade abutted on flows to the ink roller train to be scraped off there. The ink pan is detached from the support 67 for the disposal of the waste oil containing the ink, the solvent, etc. collected therein.

But, the first cleaning method is the so-called manual operation in which the ink staying on the surfaces of the ink roller train is removed by means of a knife, and the still remaining ink is wiped off by hands using cloths impregnated with a solvent. When the ink roller train mechanism has multi-stages of ink roller train, the first cleaning method takes time to clean each of the ink roller train, and smears operators' bodies, e.g., hands. These are reasons why the first method has been disliked. In the second cleaning method, since hands do not directly touch the ink roller train in the cleaning operation, operators' bodies are not smeared with the ink, but the disposal of the ink scraped off the ink roller train and collected in the ink pan is bothering. The ink pan which has been emptied of the waste oil is cleaned for the next ink roller train cleaning operation. Since cloths and a solvent are used to clean the ink pan, operators' hands are smeared, and besides, this ink pan cleaning has to be repeated for the cleaning of each ink roller train, which is very bothering to the operators.

In addition, the unwoven cloth used in the conventional blanket cleaning or the cleaning cloth for the manual wipe do not have such high oil absorbency that a large quantity of the material is required for the cleaning. Accordingly to experiments, when a used amount of a solvent was around 200 cc/time per 1 unit of A1 size machine, 1 meter of unwoven fabric was used.

A first object of this invention is to provide a method for cleaning an ink roller train which can cause ink remaining on the ink roller train to automatically permeate a web or a sheet of cleaning cloth to be held by the same, and disposes of the cleaning cloth.

A second object of this invention is to provide a method for cleaning an ink roller train which can cause ink remaining on the ink roller train to automatically permeate a web or a sheet of cleaning cloth to be held by the same, and disposes the cleaning cloth in such a manner as not to leak out the ink.

A third object of this invention is to provide a device for cleaning an ink roller train for use in printing machines which can cause ink remaining on the ink roller train to automatically permeate a cleaning cloth to be held by the same.

A fourth object of this invention is to provide a device for cleaning an ink roller train for use in printing machines which can cause the ink scraped off by a doctor blade to automatically permeate a sheet of cleaning cloth to be held by the same.

A fifth object of this invention is to provide a device for cleaning an ink roller train which comprises means for forcing a web or a sheet of cleaning cloth to hold the ink it has absorbed.

DISCLOSURE OF THE INVENTION

This invention comprises softening by a solvent ink remaining on the ink roller train for applying ink to the plate cylinder, pressing a cleaning cloth against the ink roller train and moving the same intermittently or continuously so that the oil absorptive layer of the cleaning cloth absorbs and holds the softened ink, and disposing of the cleaning cloth.

This invention is for removing ink on the ink roller train by softening the ink by a solvent, and intermittently or continuously moving a cleaning cloth in press-contact with the ink roller train and comprises an ink absorptive layer which absorbs and holds the ink softened by a solvent, and a cleaning cloth disposing section for disposing of the cleaning cloth. The cleaning cloth sent to the cleaning cloth disposing section is cut off by a cutter or wound on a taking-up roll by a certain length to be wasted together with the roll. This facilitates the disposal of the used cleaning cloth and improves the workability.

The device for cleaning an ink roller train described above comprises a cleaning cloth feed roll for paying out a cleaning cloth, a nipping roller for drawing the cleaning cloth from the cleaning cloth feed roll, and a pressure pad disposed between the roll and the roller for pressing the cleaning cloth against the ink roller train.

According to this invention, the cleaning cloth has a two-layer structure of an oil absorptive layer and an oil impermeable layer, or three-layer structure of a non-backflow oil permeable layer, an oil absorptive layer and an oil impermeable layer. Accordingly the cleaning cloth has good absorptiveness of the softened ink and is free from the leakage of the absorbed ink. Especially the cleaning cloth having the non-backflow oil permeable layer can perfectly hold the absorbed ink, and has good disposability.

The cleaning cloth of the two-layer structure has the oil absorptive layer impregnated with an oil coagulant or contains the oil coagulant distributed in the oil absorptive layer. In this case, the absorbed ink is solidified or gelatinized by cooling following heating, which facilitates the following disposal of the cleaning cloth.

Furthermore, this invent ion is for removing ink remaining on the ink roller train by softening the ink by a solvent and intermittently or continuously moving a cleaning cloth in press-contact with the ink tel let train, and comprises a web or a sheet of the cleaning cloth including an oil absorptive layer for absorbing the ink softened by the solvent impregnated with an oil coagulant, a heating section for solving the oil coagulant to mix the melted oil coagulant with the absorbed ink, and a cleaning cloth disposing section for disposing the cleaning cloth with the absorbed ink trapped in the oil absorptive layer by cooling the cleaning cloth following the heating.

Furthermore, this invention comprises an ink pan having a doctor blade on the side of the ink roller train, a sheet of cleaning cloth laid on the ink pan and having an oil absorptive layer for absorbing and holding ink softened by a solvent and scraped off by the doctor blade containing an oil coagulant, and a heating section for softening the oil coagulant and mixing the melted oil coagulant , the solvent and the ink.

This invention of these structures prohibits the absorbed ink and solvent from exuding back to smear operators' clothes, and hands and legs.

BEST MODE FOR CARRYING OUT THE INVENTION

Figure 1:
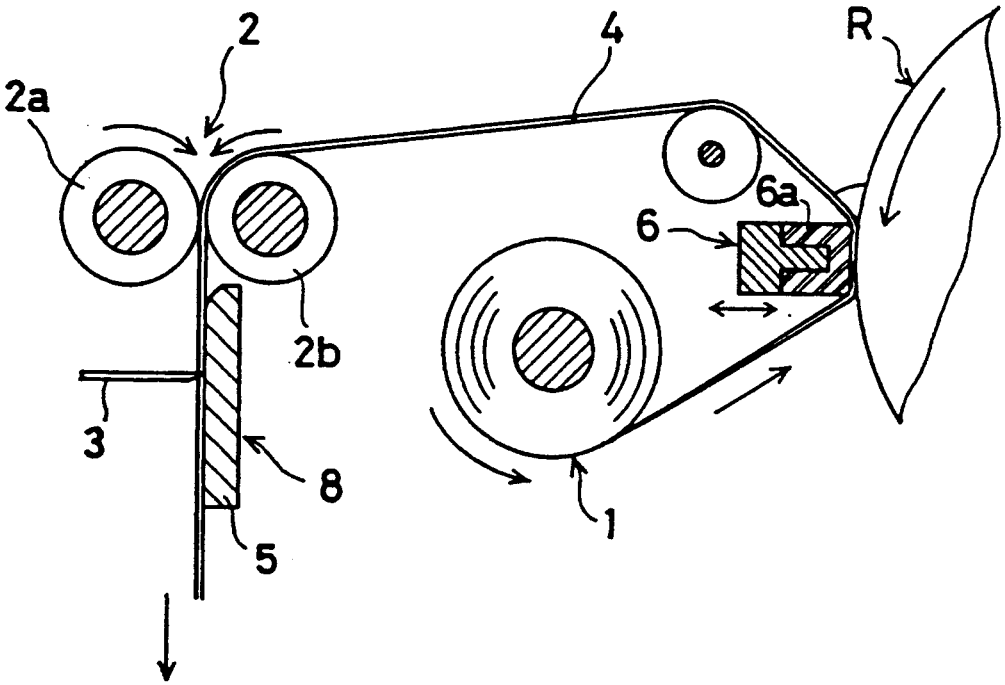
FIG. 1 is a diagrammatic view of the device for cleaning an ink roller train of the cleaning cloth-type according to a first embodiment of this invention.
Figure 10:
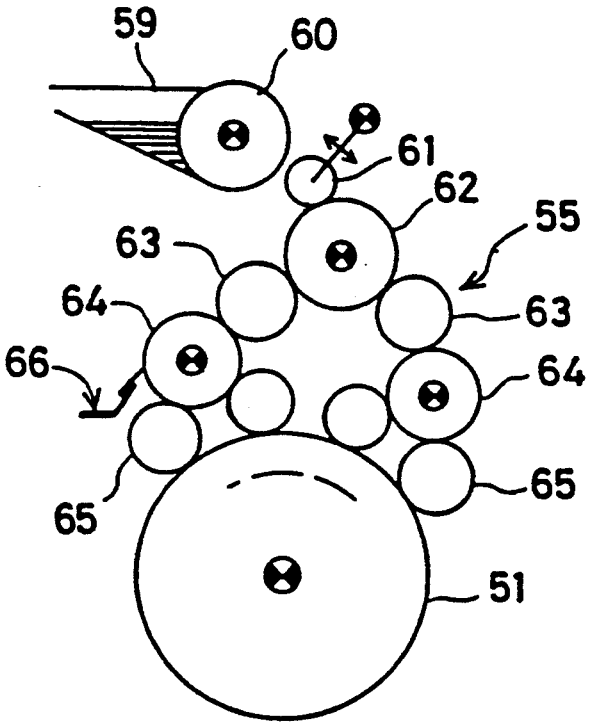
Fig. 10 PRIOR ART
FIG. 10 is diagrammatic view of the conventional device for cleaning an ink roller train.
Figure 11:
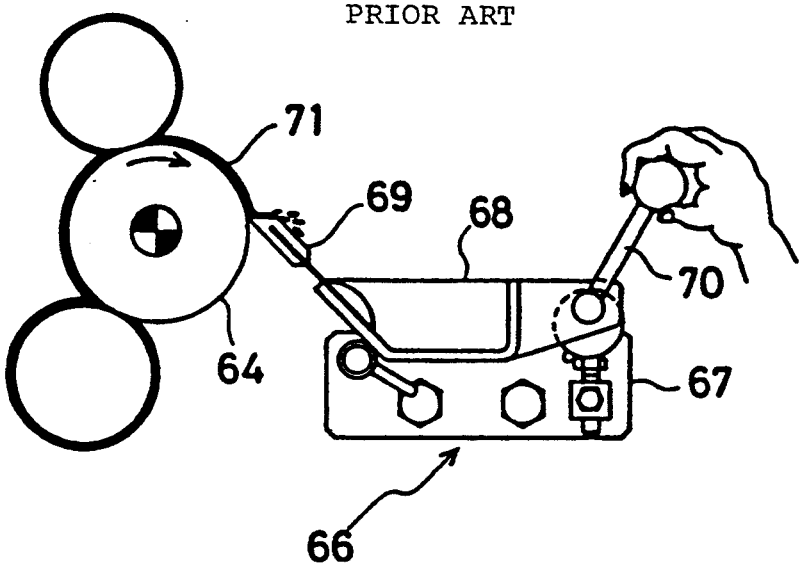
Fig. 11 PRIOR ART
FIG. 11 is a diagrammatic view of a conventional manually operable ink cleaning device.

This invention will be explained in more detail with reference to the drawings attached hereto. FIG. 1 is a diagrammatic view of the device for cleaning an ink roller train of the cleaning cloth type according to a first embodiment. In FIG. 1 the device for cleaning an ink roller train is opposed to the metal reciprocating ink rollers (hereinafter called ink roller) of the ink roller mechanism of FIG. 10. A cleaning cloth feed roll 1 and a nipping roller 2 are supported rotatably in parallel with the axial line of the ink roller by a pair of side plates attached to the frames on both sides of the body of a printing machine.

A cleaning cloth 4 wound on the cleaning cloth roll is given a required tension by the nipping roller 2. The nipping roller 2 comprises a pair of rollers 2*a*, 2*b*, and one roller 2*a*, for example, is a drive roller, and the other is a driven roller. The drive roller rotates intermittently or continuously to draw out the cleaning cloth by a set length intermittently or continuously when an ink roller train cleaning operation is performed.

Between the cleaning cloth feed roll 1 and the nipping roller 2 there is provided a cleaning cloth pressing mechanism 6 which has a pressure pad 6*a* of a resilient material for pressing the cleaning cloth against the ink roller R. The cleaning cloth pressing mechanism has drive means (not shown) for moving the pressure pad 6*a* to and from the ink roller R in the radial direct ion thereof (indicated by an arrow).

A cleaning cloth disposing section 8 for disposing of the cleaning cloth is provided on the side of the exit of the nipping roller 2.

Next, the cleaning cloth wit 1 be explained.

Figure 2:
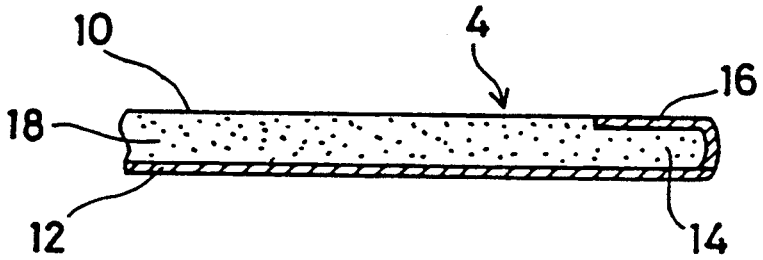
FIG. 2 is a sectional view of the cleaning cloth having the oil absorptive layer containing an oil coagulant.

FIG. 2 shows the cleaning cloth according to a first embodiment thereof. The cleaning cloth comprises an oil absorptive layer 10 of a material which well absorbs ink in contact with the ink roller R, and an oil impermeable layer 12 coating the oil absorptive layer except a portion which comes into contact with the ink roller. The oil absorptive layer 10 is made of 3~5-mm thick unwoven fabric having polypropylene fiber as the base material. The oil impermeable layer 12 is made off 10~30 micron thick plastic film, as of polypropylene. Especially the oil impermeable layer 12 is folded on the oil absorptive layer in such a manner as to enclose the border 14 of the oil absorptive layer. The folded portion 16 of the oil impermeable layer 12 prevents the ink absorbed by the ink absorptive layer from leaking at the sides.

About 200 cc of a solvent for one usual ink roller cleaning operation is required, and the cleaning cloth has to absorb all this amount. It is necessary that a small quantity (e.g., about 10 cm) of the cleaning cloth absorbs a used amount of the solvent. To satisfy this requirement, the cleaning cloth is made of a material of good oil absorptiveness and has the oil absorptive layer impregnated with an oil coagulant 18 (e.g., trade name "Yukko", Lion kabushiki Kaisha) for subjecting the absorbed ink to cooling following heating to solidify or gelatinize the same, or having microcapsules of the oil coagulant distributed therein.

Figure 3:
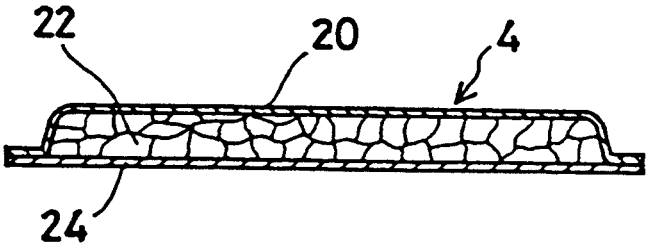
FIG. 3 is a sectional view of the cleaning cloth having the oil absorptive layer coated with the non-backflow oil permeable layer.

FIG. 3 shows the cleaning cloth according to a second embodiment thereof. The cleaning cloth has a three-layer structure comprising a non backflow oil permeable layer 20 which passes waste oil containing ink, a solvent, etc. on the side opposed to the ink roller but does not allow the waste oil to flow back, an oil absorptive layer 22 which absorbs the waste oil which has passed the oil permeable layer, and an oil impermeable layer 24 which prevents the leakage of the waste oil from the oil absorptive layer. The oil permeable layer 20 is covered by the oil impermeable layer 24 so completely that the waste oil which has permeated the oil absorptive layer never flows outside again.

Next, the disposal of the cleaning cloth which has absorbed the waste oil will be explained below.

FIG. 1 shows the cleaning cloth disposing section in which the cleaning cloth 4 is cut off with a cutter 3 to waste the same. A cutter receiving board 5 is disposed on the side of the exit of the nipping roller 2, and the cleaning cloth is put along the cutter receiving board to be cut off.

This structure makes the cleaning cloth disposing section very simple and facilitates the disposal of the used cleaning cloth.

Figure 4:
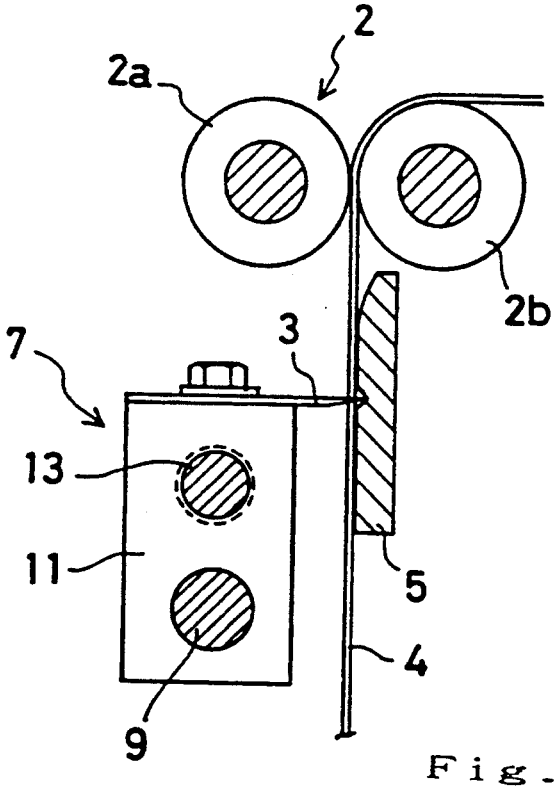
FIG. 4 is a side view of an automatic cleaning cloth cutting device.
Figure 5:
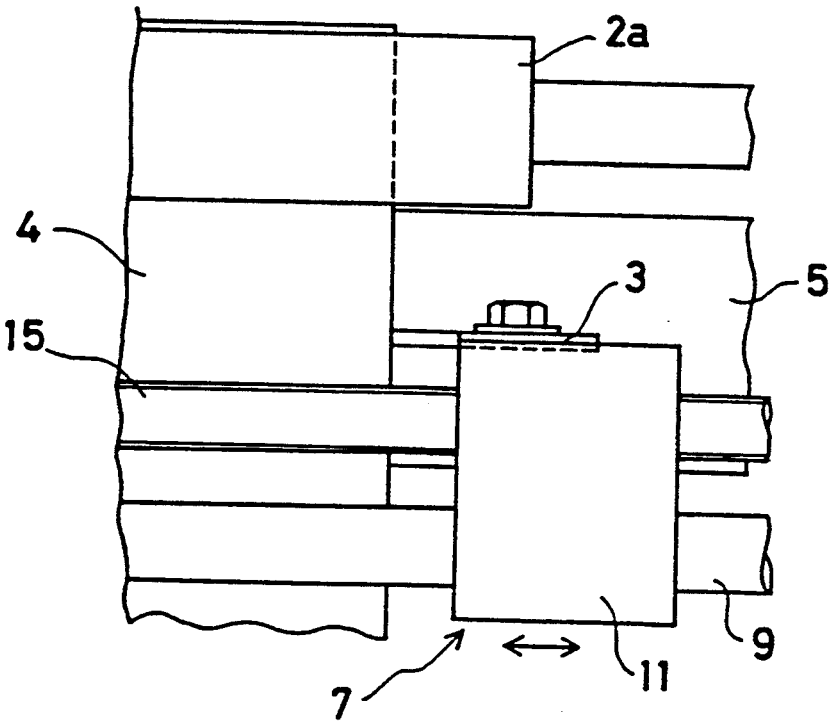
FIG. 5 is a plane view of FIG. 4.

FIG. 4 shows the cleaning cloth disposing section in which the cutter 3 is attached to a cutter driving section 7 to move the cutter 3 along the cutter receiving board 5 so as to cut the cleaning cloth 4 automatically. In the cutter driving section 7, a cutter mount 11 is supported on a guide shaft 9 parallel with the roller shaft of the nipping roller. A female screw 13 is formed through the cutter mount in the same direction as the guide shaft. A feed screw 15 is screw-engaged with the female screw of the cutter mount. This feed screw is rotated reversibly by a motor (not shown) attached to a side frame making up the body of the device for cleaning ink rollers to move the cutter mount in the directions indicated by the arrow shown in FIG. 5.

After the nipping roller 2 is stopped, and the paying-out of the cleaning cloth is stopped, the cutter driving section 7 is actuated to start the cutter 3 cutting the cleaning cloth.

Figure 6:
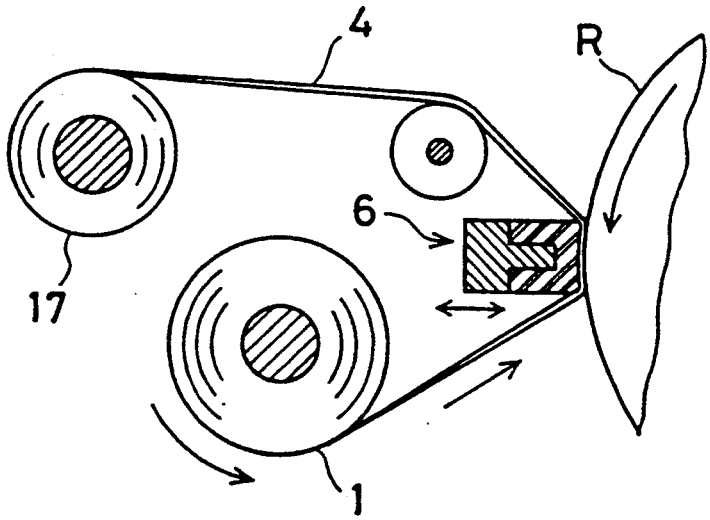
FIG. 6 is a view explaining the disposition of the cleaning cloth by the taking up roll.

FIG. 6 shows the cleaning cloth disposing section comprising a taking-up roll 17. In FIG. 6, the taking-up roll 17 is driven by driving means (not shown) to take up the cleaning cloth 14 intermittently or continuously in synchronization with the cleaning operation. When a certain amount of the used cleaning cloth is taken up by the taking-up roll, the roll with the used cleaning cloth wound on is detached to be wasted together with the used cleaning cloth.

Next, another embodiment of this invention will be explained.

Figure 7:
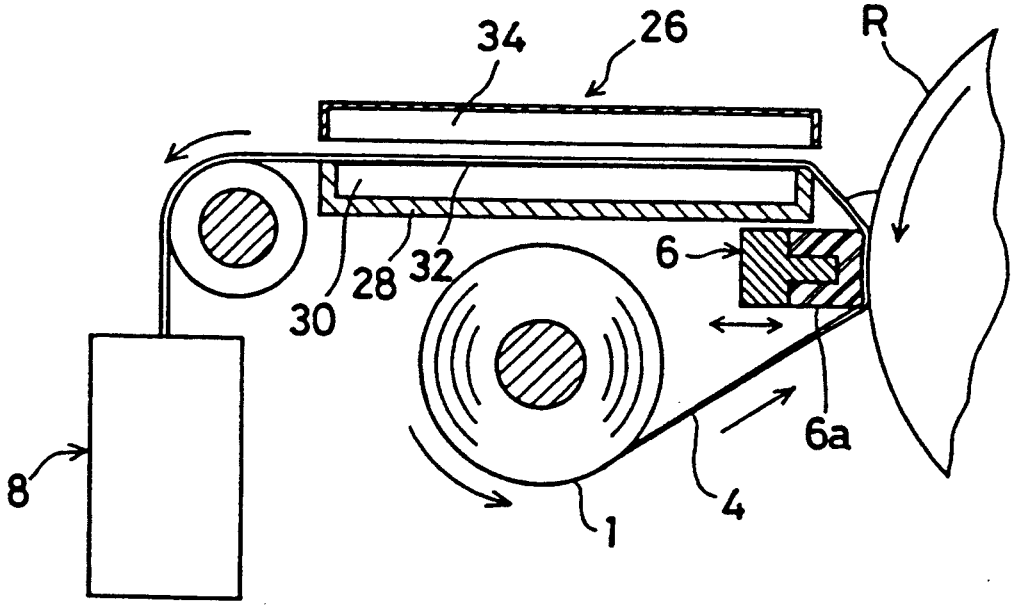
FIG. 7 is a diagrammatic view of the device for cleaning an ink roller train with heating means according to a second embodiment of this invention.

FIG. 7 is a diagrammatic view of the device for cleaning an ink roller train comprising heating means for solidifying or gelatinizing waste oil absorbed in the cleaning cloth. In FIG. 7, a heating section 26 is disposed between the pressure pad 6a and the cleaning cloth disposing section 8. This heating section 26 comprises a heater 30 which is housed in a case 28 of a heat insulative material and is covered at the top surface with a heat durable and oil resistant sheet 32, such as Teflon, and a hood 34 disposed above the heating area of the heater.

The cleaning cloth 4 which has passed through the heating section 26 enters the cleaning cloth disposing section 8 for the disposal operation thereof. The cleaning cloth disposing section comprises the above-described cleaning cloth cutting section 7 and taking-up roll 17.

Next, the operation of the heating section will be explained.

Ink softened with a solvent enters the heating section, absorbed by the oil absorptive layer of the cleaning cloth. The heating section heats the cleaning cloth through the Teflon to melt the oil coagulant in the oil absorptive layer of the cleaning cloth. The heating temperature at this time is about 100° C. The melted oil coagulant is mixed with the ink and goes out of the heating section to be cooled. Then the oil coagulant again coagulates to solidify or gelatinize the ink. The ink is thus kept in the cleaning cloth, which facilitates the disposal of the cleaning cloth in the following cleaning cloth disposing section.

Figure 8:
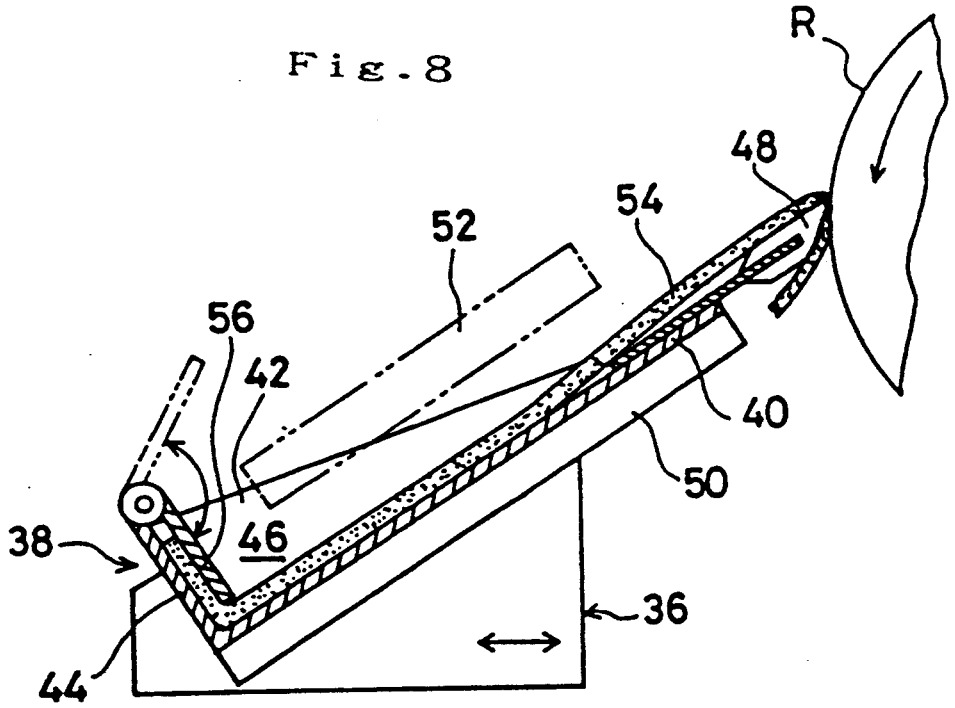
FIG. 8 is a diagrammatic view of the device for cleaning an ink roller train of the doctor blade-type according to a third embodiment of this invention.
Figure 9:
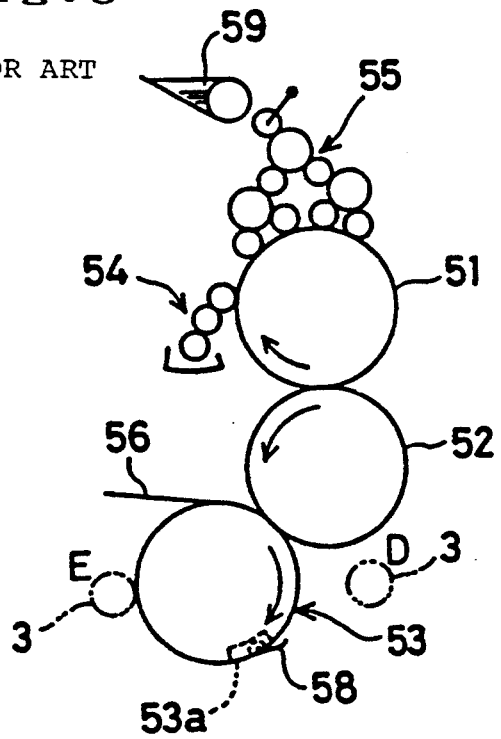
Fig. 9 PRIOR ART
FIG. 9 is diagrammatic view of the offset printing machine explaining the inking arrangement.

FIG. 8 is a diagrammatic view of the device for cleaning an ink roller train of the doctor blade-type which uses the cleaning cloth.

The device for cleaning an ink roller train comprises a support base 36 disposed movable radially to and from the ink roller R on a base body (not shown) attached to the frame of the body of a printing machine, and an ink pan 38 mounted on the support base 36, and the support base 36 is advanced by driving means (not shown) to the ink roller R for the cleaning operation.

The ink pan 38 includes an oil receiver 46 defined by a bottom plate 40, both side plates 42 reducing the height toward the ink roller R and a side plate 44 positioned opposite to the ink roller, and a doctor blade 48 attached to a portion of the bottom plate nearer to the ink roller. On the underside of the bottom plate there is provided a heater 50 for heating the entire backside, and above the oil receiver there is provided a heater 52, e.g., an infrared heater, for heating a sheet of cleaning cloth at the top surface. The sheet of cleaning cloth 54 having an oil absorptive layer containing an oil coagulant is to be laid on bottom plate. The sheet of cleaning sheet is laid on the ink pan with one side fixed by a clamp provided on the side plate 44 of the ink pan and with the other side folded on the back side over the tip of the doctor blade 48 in such a manner as to wrap the doctor blade.

Next, the operation of this embodiment will be explained.

The support base is advanced to bring the doctor blade into contact with the ink roller, ink softened by a solvent is scraped off by the doctor blade. The scraped ink flows to the oil receiver of the bottom plate while permeating the cleaning cloth 54 laid on the bottom plate.

The sheet of cleaning cloth has a set thickness and area enough to absorb an amount of the solvent for one cleaning operation. This enables all the ink to permeate the sheet of cleaning cloth short of the oil receiver.

Subsequently, the sheet of cleaning cloth is subjected to the treatment of solidifying the ink. That is, when the support base is withdrawn, and then the heater is turned on, the sheet of cleaning cloth is heated to thereby melt the oil coagulant, and the melted oil coagulant mixes with the ink. In this state, the heater is turned off to air-cool the sheet of cleaning cloth, and the ink is solidified or gelatinized by the oil coagulant. Then, the clamp 56 is released (indicated by the two-dot chain line) to remove the sheet of cleaning cloth from the ink pan to be wasted. Since the portion of the sheet of cleaning cloth which has been clamped is clean, at this time the sheet of cleaning cloth can be held at the portion to be disposed of without smearing hands.

In this embodiment, heaters are disposed on the underside of the bottom plate and above the sheet of cleaning cloth, but this is not an essential feature, and a heater may be disposed selectively on only either side as required.

According to the embodiments, the front portion of the pressure pad, which is the contact portion with the ink roller, is extended in the circumferential direction of the ink roller, and the front surface of the contact portion is in a concave shape of substantially the same curvature as that of the ink roller, which increases the contact area of the cleaning cloth to the ink roller, which improves the effect of the wiping operation.

INDUSTRIAL APPLICABILITY

As described above, the method and the device for cleaning an ink roller train for use in printing machines are effective to remove ink remaining on the ink roller train which apply ink to the plate cylinders, and are suitable to facilitate disposing of used cleaning cloth.

We claim:

1. A device for cleaning ink from an ink roller train for use in printing machines comprising, in combination, means for applying solvent to the ink roller train to soften the ink; a roll supply of cleaning cloth; means for intermittently or continuously moving the cleaning cloth in press-contact with the ink roller train to remove the ink softened by the solvent, wherein the cleaning cloth has a three-layer structure of a non-backflow oil permeable layer, and oil absorptive layer, formed with an oil coagulant material, and an oil impermeable layer, for absorbing the ink softened by the solvent to hold the same; a heating means for melting the oil coagulant and mixing the melted oil coagulant with the absorbed ink; and a cleaning cloth disposing section for disposing of the cleaning cloth.

2. A device for cleaning an ink roller train for use in printing machines according to claim 1, wherein the oil absorptive layer of the cleaning cloth is enclosed by the non-backflow oil permeable layer and the oil impermeable layer.

3. A device for cleaning ink from an ink roller train for use in printing machines comprising a means for applying solvent to the ink roller train to soften the ink; a web or sheet of cleaning cloth; means for intermittently or continuously moving the web or sheet of cleaning cloth in press contact with the ink roller train to remove the ink softened by the solvent, wherein the web or sheet of cleaning cloth has an oil absorptive layer for absorbing the ink softened by the solvent and an oil coagulant in the oil absorptive layer; a heating section for melting the oil coagulant and mixing the melting oil coagulant with the absorbed ink; and a cleaning cloth disposing section for disposing of the cleaning cloth with the ink held in the oil absorptive layer by cooling following the heating.

4. A device for cleaning ink from an ink roller train for use in printing machines comprising, in combination, means for applying solvent to the ink roller train to soften the ink; a roll supply of cleaning cloth; means for intermittently or continuously moving the cleaning cloth in press-contact with the ink roller train to remove the ink softened by the solvent, wherein the cleaning cloth has a two-layer structure of an oil absorptive layer having opposing side edges and an oil impermeable layer covering the back side of said oil absorptive layer and wrapping over said opposing side edges for preventing leakage of the ink and solvent from the back and side edges of said oil absorptive layer, wherein the cleaning cloth contains an oil coagulant, wherein said oil coagulant is impregnated into said oil absorptive layer of said cleaning cloth or is distributed in said oil absorptive layer of said cleaning cloth; and a cleaning cloth disposing section for disposing of the cleaning cloth.

* * * * *